United States Patent [19]

Hippert

[11] 4,444,245

[45] Apr. 24, 1984

[54] CONTINUOUS CASTING APPARATUS

[75] Inventor: P. Hippert, Dudelange, Luxembourg

[73] Assignee: Arbed S.A., Luxembourg

[21] Appl. No.: 342,396

[22] Filed: Jan. 25, 1982

[30] Foreign Application Priority Data

Jan. 27, 1981 [LU] Luxembourg ..... 83099

[51] Int. Cl.[3] ..... B22D 11/00; B22D 27/02

[52] U.S. Cl. ..... 164/504; 164/468

[58] Field of Search ..... 164/504, 468, 499, 147.1

[56] References Cited

U.S. PATENT DOCUMENTS

| | | | |
|---|---|---|---|
| 4,103,730 | 8/1978 | Dussart | 164/504 X |
| 4,390,057 | 6/1983 | Reuter | 164/459 |

FOREIGN PATENT DOCUMENTS

| | | | |
|---|---|---|---|
| 229759 | 2/1969 | U.S.S.R. | 164/504 |
| 416156 | 7/1974 | U.S.S.R. | 164/147.1 |
| 549242 | 5/1977 | U.S.S.R. | 164/504 |

*Primary Examiner*—Kuang Y. Lin
*Assistant Examiner*—J. Reed Batten, Jr.
*Attorney, Agent, or Firm*—Karl F. Ross; Herbert Dubno

[57] ABSTRACT

A continuous casting apparatus in which a multi-plate continuous casting mold is provided with an electromagnetic inductor for imparting rotary motion to the molten metal within the mold. Each plate is provided with a cooling chamber on its side turned away from the molten metal and an inductor is disposed around the mold so that the poles of the inductor approach the cooling chambers and are formed with passages through which threaded bolts can pass to serve as demountable support elements whereby the inductor is affixed to the chambers and by the latter to the mold. The passages run parallel to the planes of the sheets forming the laminated inductor. The withdrawal of the bolts permits separation of the inductor from the cooling chambers and thus separation of the plates so that grinding and removal of shims can compensate for the wear of the cavity-defining surfaces.

5 Claims, 6 Drawing Figures

CONTINUOUS CASTING APPARATUS

CROSS REFERENCE TO RELATED APPLICATIONS

This application is related to application Ser. No. 259,093 filed Apr. 30, 1981, now U.S. Pat. No. 4,390,057, as a continuation-in-part of Ser. No. 215,153 filed Dec. 11, 1980 and now abandoned by Hans-Josef REUTER, both based upon a Luxembourg application No. 81.982 filed Dec. 11, 1979, since issued as a Luxembourg patent with the same number.

FIELD OF THE INVENTION

My present invention relates to an apparatus for the continuous casting of metals, especially ferrous metals such as steel. More particularly, the invention relates to an assembly of the type in which a continuous-casting mold is associated with an inductor whose poles are energized by electromagnetic coils to induce a magnetic field within the mold cavity and hence rotary motion of the molten metal within the mold.

BACKGROUND OF THE INVENTION

In the continuous casting of steel bodies it is known to utilize continuous casting molds which may be curved, as described at pages 707 ff. of the *Making, Shaping and Treating of Steel*, published by the United States Steel Company, Pittsburgh, Pa., Ninth Edition, 1971.

Molds of this type are filled from above with molten metal, generally by a tundish and/or ladle, the molten steel solidifying in the mold into a continuously-cast ingot.

To reduce the imperfections which appear in the ingot, a continuous casting mold may be associated with an inductor which is energized with alternating current to induce an alternating magnetic field within the mold in the region in which the metal is still molten. This magnetic field, in turn, propels the molten metal in a rotary motion which prevents the development of large inclusions, segregations or pockets of impurities in the continuous casting.

The continuously cast ingot is withdrawn from the lower end of the mold and continuous casting can be dressed, cut into length, rolled or otherwise processed into bodies of any desired shape and form.

While molds of various shapes and constructions have been provided, plate-type molds have been used to a significant extent in the continuous casting process for the production of continuous castings of square, rectangular and other polygonal profiles or cross sections.

A plate-type mold is a mode whose cavity is defined by a plurality of plates which are assembled together so that they abut or adjoin at the corners of the mold cavity. Such plate-type molds can be designed to impart a predetermined bend to the continuous casting as it is formed and in the casting direction to avoid bending stresses in the relatively thin shell of hardened steel surrounding the soft inner core of the continuous casting emerging from the mold.

The problems involved with such plate-type continuous casting molds and a solution to the specific problem of wear of the mold, are described in the aforementioned copending applications and the Luxembourg patent which are hereby incorporated by reference.

More specifically, plate-type molds have a decisive economic advantage by comparison with tubular molds. It is obvious that the economy of a continuous casting process depends at least in part on the left of the mold, i.e. the longer a given mold can be induced to last, the less the mold cost per ton of product will affect the economy of the continuous casting process.

Tubular molds, like plate molds, are subject to wear by erosion as the molten and solidifying metal moves through them. Thus it is advantageous to be able to renew the worn interior surfaces. It is also important to be able to restore both the original profile (cross section) and dimensions, i.e. the internal dimensions of the mold cavity.

This cannot practically be achieved with tubular molds except by depositing a layer upon the worn surfaces, a process which is prohibitively costly.

In the aforementioned copending applications and patent, a plate mold is described whereby wear can be compensated in a simple and economical manner. For example, the plate mold of this system can comprise four individual plates formed with recesses at their outer edges and interfilling in such a manner that, with grinding of the junction surfaces and by insertion of shims where the plates adjoin, it is possible to compensate precisely for the wear of the cavity-defining surfaces so that, with grinding of the abutment edges and insertion of the shims into the recesses, the mold cavity can be restored to its original dimensions. More specifically, the plate mold of these earlier systems is formed by four individual plates each having recesses at outer parts which interfit with the recesses and shoulders of adjoining plates so that contact edges between the mold surfaces can be adjusted to the same level by means of shims inserted into these recesses.

At the outer part the inner surfaces of two oppositely displaced plates are provided with bevels such that the mold cross section has eight angles corresponding to eight surfaces, four of which may be large while the other four merely form beveled corners of the continuous casting.

For compensating the worn interior faces so as to restore the mold cavity to its original dimensions, a thickness (a) is removed by any conventional machining process, e.g. grinding, from the plates having the bevels at their inner surfaces as well as from the contact surfaces while a thickness equal to the product of (a) and the cosine of the bevel angle is removed from the bevels. A thickness (b) is removed from the plates without the bevels and shims between the plates are reduced by a corresponding amount. The thicknesses (a) and (b) can be the same or different.

With this system, a plate mold can be refinished a number of times, always with resetting of the mold cross section to its original dimensions. The number of times for which this process can be repeated is limited only by the availability of shims in the recesses.

It has already been indicated that plate molds can be used in combination with electromagnetic inductors for generating rotary motion of the molten metal. In earlier constructions, the plate molds had to be supported by special frames for geometric and structural stability. These frames were disposed within the space surrounded by the inductor. Since they were composed of metal they absorbed and dissipated a significant part of the magnetic energy, a portion of the input power is lost and for a given delivery of electromagnetic power to the molten metal, a correspondingly larger inductor with higher output is required.

OBJECTS OF THE INVENTION

It is the principal object of the present invention to provide a plate mold and inductor assembly for continuous casting whereby the disadvantages of earlier systems can be obviated.

Another object of this invention is to provide such an assembly which can be operated more efficiently in terms of the power which must be supplied for the generation of a given rotary movement in the molten metal.

Still another object of the invention is to provide a more compact and simple apparatus having a high degree of structural stability, low power loss and ease of dismounting to enable reworking of the plates of the plate mold to reset a given mold cavity profile.

SUMMARY OF THE INVENTION

These objects and others which will become more readily apparent hereinafter are attained, in accordance with the present invention, by a system for the purposes described in which each plate of the plate mold is provided on its side turned away from the mold cavity with a cooling chamber connected to the respective plate and closely surrounded by the core of the inductor.

More specifically, each cooling chamber is in force contact with the outwardly turned side of a mold plate, e.g. bolted thereto, and the inductor core is composed of an electrical steel sheet stack which has pole pieces reaching toward these cooling chambers and provided with throughgoing passages parallel to the laminations or sheets of the stack.

Through these passages, dismountable or retractable support elements (bolts) extend for securing the core to the cooling chambers, a stack of the inductor therefor forming the support for the entire apparatus previously described.

Advantageously the sheet stack can be formed with threaded members, e.g. nuts welded to the exterior of the stack in alignment with the passages and into which bolts are threaded, the bolts forming the support elements by bearing with their inner ends against the cooling chambers which can have recesses receiving these inner ends.

In order to provide the passages in the sheet stack through which the support elements pass, correspondingly dimensioned individual sheets whose edges are spaced apart to define the passage, may be utilized within the stack.

Where the edges of sheet members of a layer are spaced apart by a distance corresponding substantially to the diameter of the support element, rectangular passages are generated. Of course, with correspondingly shaped or dimensioned sheet edges, rounded passages can also be produced without difficulty.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1A:
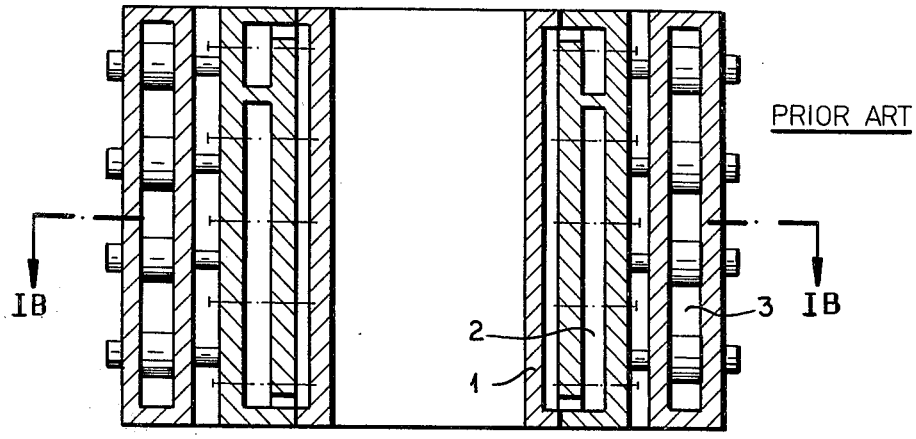
FIG. 1A is a vertical section through a prior art arrangement in which a plate mold and its cooling chambers can be surrounded by an inductor.
Figure 1B:
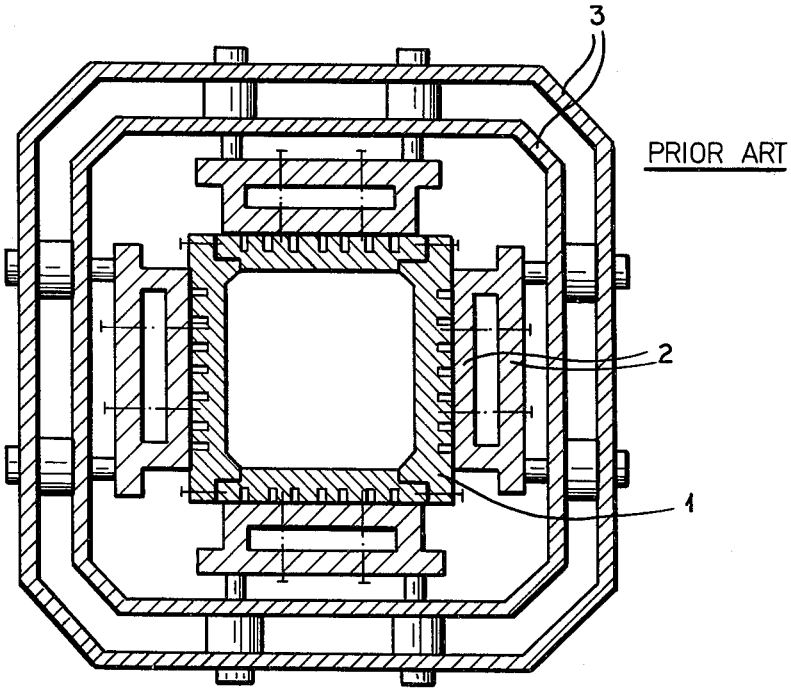
FIG. 1B is a cross section taken along the line IB—IB of FIG. 1A.

FIGS. 1A and 1B show a plate mold 1, which can be of the type described in the aforementioned copending applications, provided with cooling chambers 2 mounted on a frame 3 and in turn, surrounded by an inductor (not shown) which, because of the presence of the frame 3, must have very large dimensions, relative to the size of the mold and hence the molten mass within the mold cavity which is to be set in motion by the inductor.

Because of the large spacing of the inductor from the molten metal, and the fact that magnetic energy is dissipated within the frame, very large input powers are required to induce the rotary movement of molten metal.

These disadvantages are obviated in accordance with the principles of the present invention best seen in FIGS. 2, 2A, 2B or FIG. 3.

Figure 2:
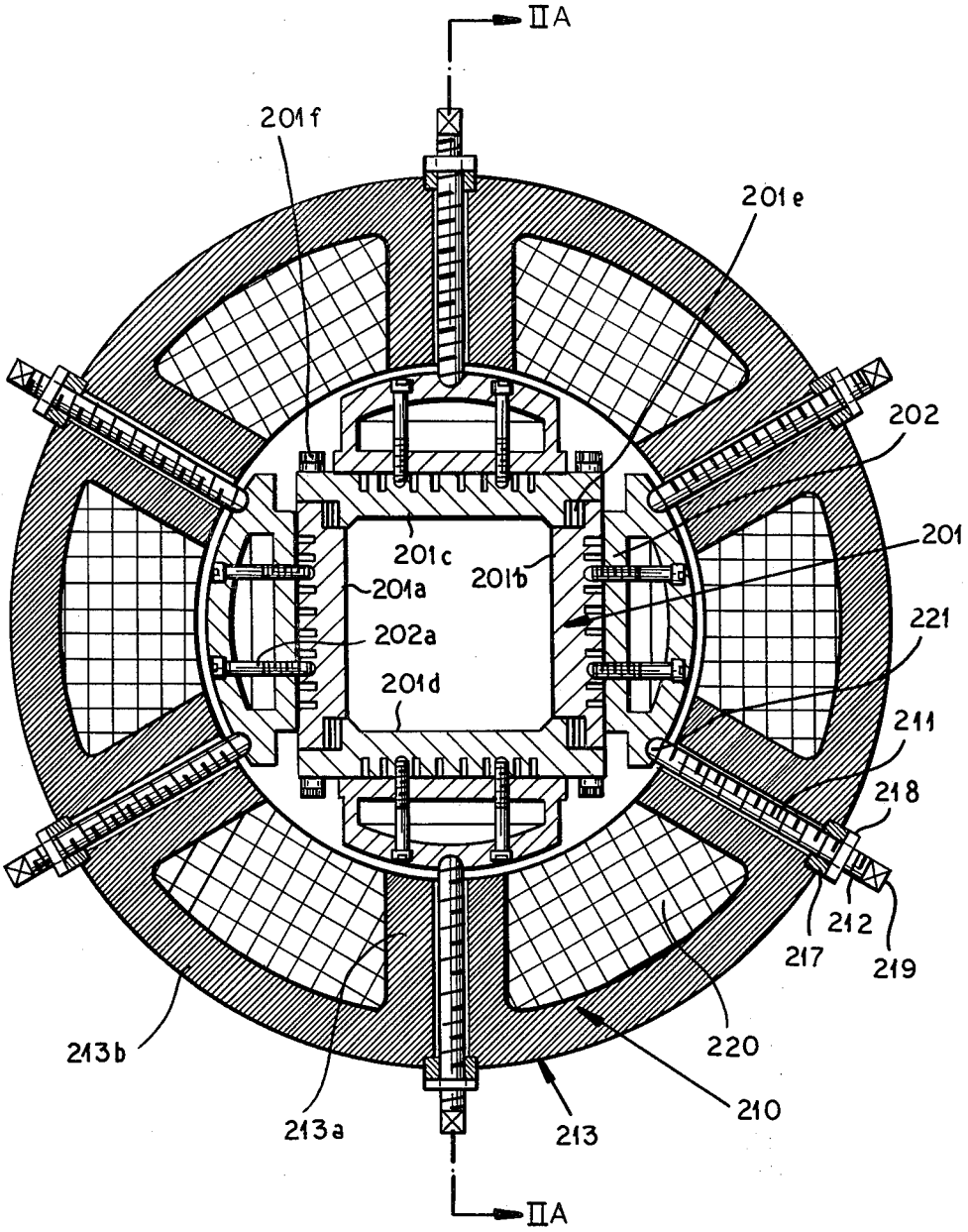
FIG. 2 is a section taken in a horizontal plane through a plate mold and attached inductor according to this invention.
Figure 2A:
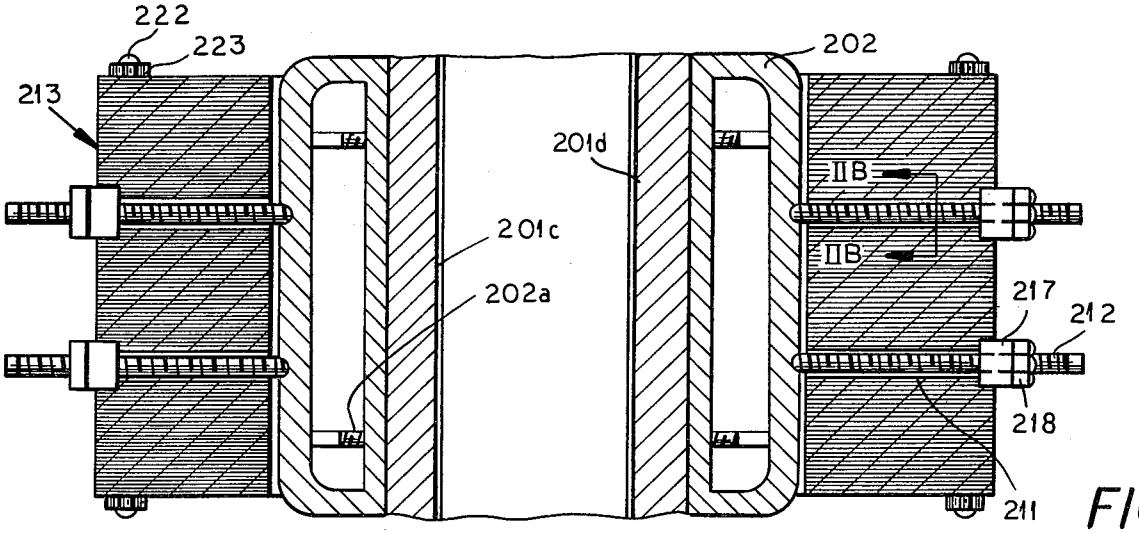
FIG. 2A is a section taken along the line IIA—IIA of FIG. 2.
Figure 2B:
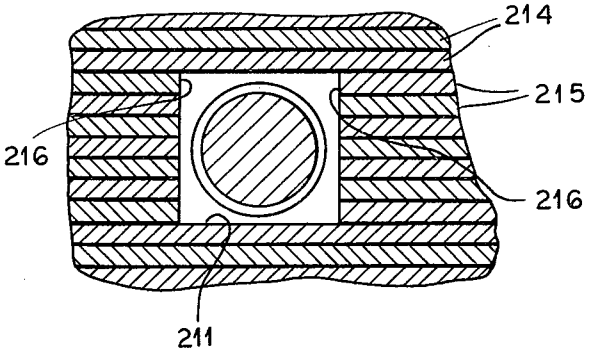
FIG. 2B is a detail view drawn to a larger scale, representing a section along the line IIB—IIB in FIG. 2A.

In the embodiments of FIGS. 2, 2A and 2B, the mold 201 can be seen to comprise four plates **201*a*, 201*b* and 201*c*, 201*d*, the latter having the bevels previously mentioned. Shims are provided as shown in 201*e* to allow refinishing of the mold in the manner previously described. The plates are held together by bolts 201*f* and, in turn, are carried by cooling chambers 202 which are secured to the outer faces of the plates by bolts 202*a***. Circulation of water through the cooling chambers can be effected by any conventional means.

In the system of the invention, an inductor 210 closely surrounds the mold and cooling chamber without the interposition of a frame, the inductor comprising a core 213 which is formed of electrical sheets 214, 215 (see FIG. 2B). The sheet stack or core 213 is formed with radially extending pole pieces **213*a* which reach inwardly toward the cooling chambers 202 and are interconnected by segments 213*b*. Around the poles 213*a*, coils 220**, shown only diagrammatically, are wound. The embodiment illustrated in FIGS. 2, 2A and 2B utilize a six-pole inductor where two poles are juxtaposed with the cooling chambers of two opposite plates and the other four poles are juxtaposed with the other two cooling chambers.

Of course, at least one pole is juxtaposed with each cooling chamber. The number of poles is not limited to the embodiment shown and, for example, a four-pole inductor can be provided with each pole juxtaposed with a respective cooling chamber or an 8-pole inductor can be provided, with each cooling chamber juxtaposed with a pair of inductor poles.

A throughgoing passage 211 extends radially through each pole and can be defined, as shown in FIG. 2B, by spaced-apart edges 216 of sheet members 215 of corresponding layers so that the passage has a square cross section whose width slightly exceeds the diameter of the supporting elements 212 traversing the passage.

In the embodiment illustrated, each supporting element 212 comprises a bolt which is threaded into a nut 217 welded to the sheet stack in registering the respective passage and is secured in place by a locking nut 218.

The bolt can have a prismatic head 219 to enable it to be engaged by a socket wrench or the like. The inner end of each bolt 212 is round and fits into a recess 221 formed in the outer wall of the respective cooling chamber.

The sheet stack, which can be held together by tie bolts 22 and nuts 223, thus forms a structurally rigid unit which can be supported in a desired frame work and in turn supports the mold and the cooling chambers.

The mold of FIGS. 2, 2A and 2B operates in accordance with the principles previously described but without the excessive power losses because of the proximity of the inductor poles to the molten metal. In addition by simply taking out the bolts 212, it is possible to release the mold and thereby allow disassembly thereof for restoration of the original cavity cross section dimensions.

Figure 3:
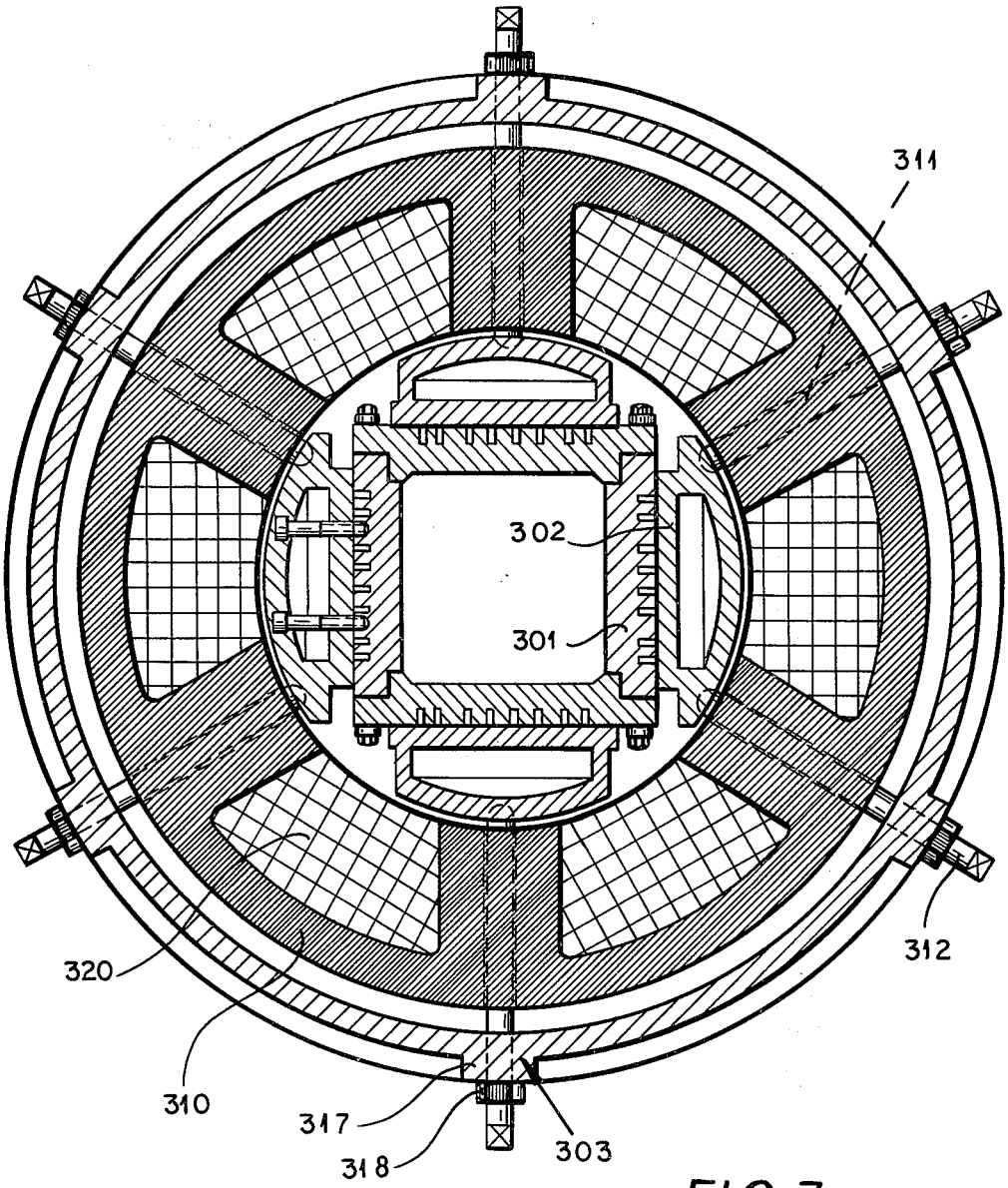
FIG. 3 is a view similar to FIG. 2 illustrating another embodiment.

In FIG. 3, in which similar reference numerals in the 300 series represent elements functionally similar to those of FIG. 2, a frame 303 surrounds the inductor 310 and is provided with threaded bores 317 into which the support elements 312 can be screwed to engage the cooling chambers 302 in the mold 301. The threaded bores 317 are aligned with the passages 311 in the poles of the inductor, whose coils are shown at 320.

This frame can be provided if the deforming forces cannot be opposed by the inductor itself or, for some reason, are not to be opposed by the inductor itself. Generally this frame will not be required.

The withdrawal of the support elements allows access to the mold as previously described for restoration of the original cross section.

I claim:

1. A continuous casting apparatus comprising:

a plate mold including a plurality of interconnected mold plates defining a mold cavity adapted to receive a melt for the continuous casting thereof;

a respective cooling chamber affixed to a side of each of said plates turned away from the mold cavity;

an inductor surrounding said mold and said cooling chambers, said inductor comprising a core formed by a stack of laminations and including pole pieces reaching toward said cooling chambers, each of said pole pieces being traversed by a respective passage parallel to the laminations of said stack; and respective support elements extending through said passages and engaging said cooling chambers for connecting said inductor to said mold, said inductor having coils energizable to magnetically induce rotary movement of the melt, said pole pieces being directly juxtaposed with said cooling chambers and said support elements being retractable to allow dismounting of said mold from said inductor.

2. The apparatus defined in claim 1 wherein said passages are defined by spaced-apart edges of sheet members forming laminations of said stack, the spacing of said edges corresponding approximately to the width of said support element traversing the respective passage.

3. The apparatus defined in claim 1, further comprising a frame surrounding said inductor, said support elements being secured to said frame outwardly of said inductor.

4. The apparatus defined in claim 1, claim 2 or claim 3 wherein said support elements are threaded bolts, and further comprising counternuts fixing said bolts against rotation.

5. The apparatus defined in claim 4 wherein said passages are of rectangular cross section.

* * * * *